United States Patent [19]

McCollin et al.

[11] Patent Number: 4,506,730

[45] Date of Patent: Mar. 26, 1985

[54] DEVICE FOR ASSEMBLING JACKETED LENGTHS OF PIPE BASE WELL SCREENS

[75] Inventors: Chris D. McCollin, Shoreview; Richard E. Allred, Chisago City; Leslie K. Bearl, Anoka; David C. Card, New Brighton, all of Minn.

[73] Assignee: UOP Inc., Des Plaines, Ill.

[21] Appl. No.: 585,677

[22] Filed: Mar. 2, 1984

[51] Int. Cl.[3] ..... E21B 41/00

[52] U.S. Cl. ..... 166/85; 403/344; 285/373

[58] Field of Search ..... 166/85, 227, 231–233, 166/236, 235, 377, 378, 379; 403/344, 225, 226; 285/373, 419

[56] References Cited

U.S. PATENT DOCUMENTS

| | | | |
|---|---|---|---|
| 3,041,088 | 6/1962 | Brandon, Jr. | 285/373 X |
| 3,425,757 | 2/1969 | Minor | 403/344 X |
| 3,908,256 | 9/1975 | Smith | 166/233 X |

*Primary Examiner*—Stephen J. Novosad
*Assistant Examiner*—Thuy M. Bui
*Attorney, Agent, or Firm*—William H. Page, II; Barry L. Clark

[57] ABSTRACT

Device for facilitating the assembly of lengths of jacketed pipe base well screens in wells, wherein assembly is to be with manual or power tongs which have a greater vertical height than the blank pipe base end sections of the screens. The device includes a pair of pivoted semicylindrical portions which have compressible rubber liners at their ends which overlie the screen jacket and jaws at their ends which overlie the blank pipe. A removable pin locks the screen jacket end of the device at a fixed O.D. while the jaw end has a gap between the nonpivoted edges of the pivoted portions which permits a reduction in diameter as force from a set of tongs compresses the device and the jaws therein against a blank section of pipe.

5 Claims, 5 Drawing Figures

FIG. 1
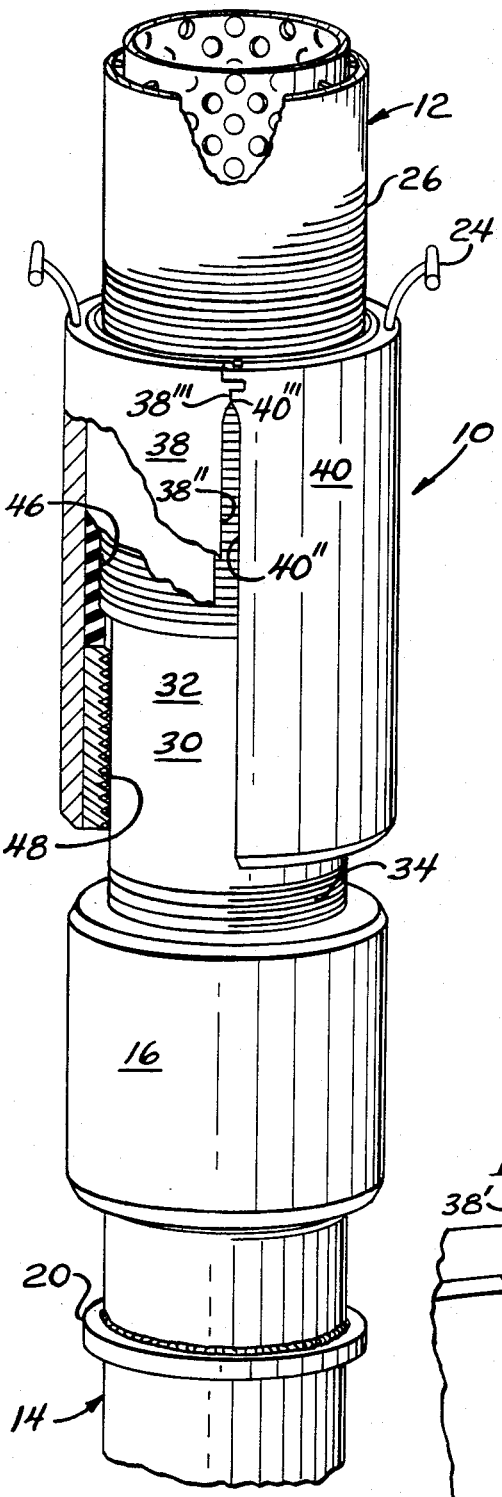
FIG. 2
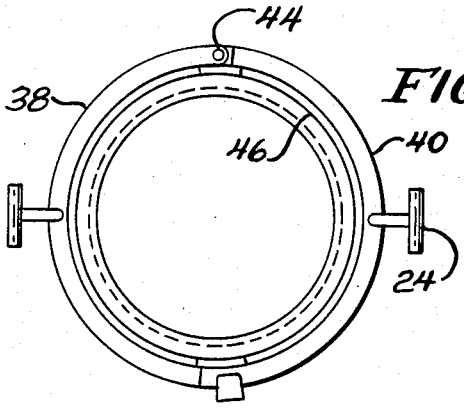
FIG. 3
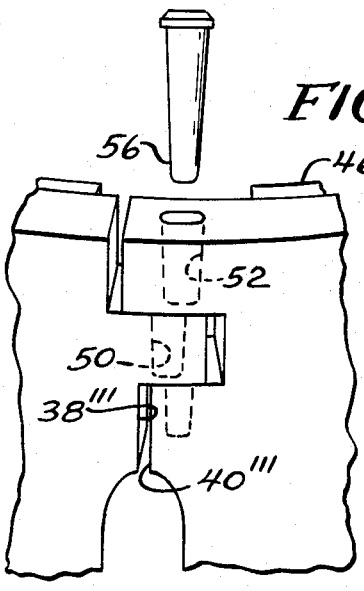
FIG. 5
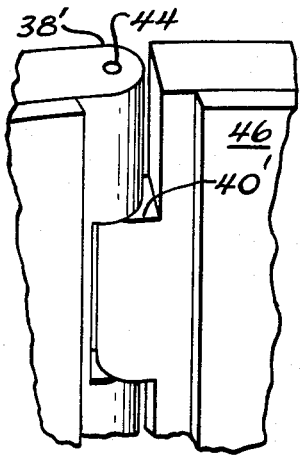
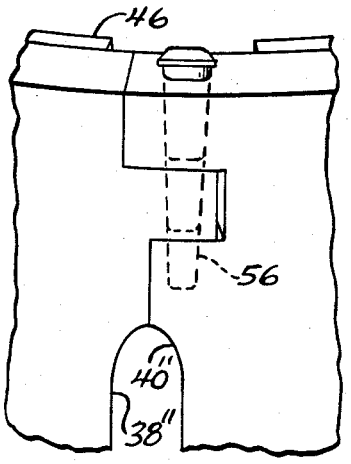
FIG. 4

DEVICE FOR ASSEMBLING JACKETED LENGTHS OF PIPE BASE WELL SCREENS

BACKGROUND OF THE INVENTION

In the construction of oil wells, it is customary to place a string made up of lengths of slotted well screens in the producing regions of the well to collect the oil while screening out sand or other particulate matter from the strata being produced. Typically, the wells are quite deep and the well pipe is of a relatively large diameter, such as $4\frac{1}{2}''$—$9\frac{5}{8}''$. The tremendous weight involved generally makes it necessary that the well screens used by very strong, necessitating the use of well pipe as a central support core. The lengths of pipe, usually 20', are threaded on each end so they can be joined by threaded couplings. An intermediate section of each length is perforated and surrounded by a screen jacket which usually comprises a series of longitudinal stainless steel rods which have a stainless steel wire helically wrapped around them and welded to them so as to form a continuous helical slot. Rings at the ends of the wrapped wire are then welded or otherwise attached to unperforated or blank sections of the pipe adjacent the perforated section. Such a screen is termed a "pipe base" screen and generally has about a 12" blank pipe section at each end between the screen jacket and pipe end threads to accommodate the tongs used on a drilling rig to screw pipe segments together. The extended region of blank pipe is necessary since the tongs have a height in the axial direction of the pipe of about 6–10" and since some additional blank area is needed to prevent destruction of the relatively fragile screen jacket by inadvertent contact with the tongs. The requirement for about 24" of blank pipe of each 20' length of pipe plus about another 10" for the couplings means there is about 34" out of every 20' not available for oil production. For example, in a typical installation of 240' of pipe base screen in a production zone in an oil well, there would be twelve 20' lengths of screen in the string and eleven connections. Multiplying 34" of blank pipe length per length by eleven gives a product of 374" or 31' of length which cannot produce. In view of this substantial loss of production area, it would seem highly desirable to be able to reduce the length of blank pipe while simultaneously increasing the length of the screen jacket. For example, if each of the blank pipe regions in the aforementioned example could be reduced from 12" to 4", there would be about a 24% reduction in lost production length from 374" to 286". Furthermore, the reduction in blank pipe area would permit more total oil to be produced from the formation.

SUMMARY OF THE INVENTION

It is among the objects of the present invention to provide a device which will permit much shorter than usual lengths of blank pipe to be used at the ends of screen jacketed well screens of the type which are adapted to be connected in series in an oil well, thereby increasing the production from the screened zone of the well.

It is another object to provide a device for joining successive lengths of well screens which will protect the screens from damage during assembly, even when tongs are used.

The foregoing and other objects are achieved by the assembly device of the present invention whichh has a body comprising a pair of pivoted semicylindrical metal members having a length much longer than the length of blank pipe which is axially adjacent a screen jacket. The metal members have internal jaws positioned thereon over a minor portion of their length and an elastomeric liner such as neoprene over a major portion of their length. The metal members are vertically hinged together along one edge but their other edges cannot normally contact each other except at the end having the elastomeric lining wherein they have cooperating means such as overlapping apertured tabs which are adapted to receive a tapered fastener pin. This arrangement permits the members to be moved sufficiently close together to compress the elastomeric liner against the screen jacket. It thereby retains the vertical position of the members relative to the screen jacket while insuring that further squeezing together of the members by the application of tongs cannot damage the screen jacket, even though the tongs overlie the screen jacket. The aforementioned other edges, which are spaced so they cannot normally contact each other, can be brought closer together by the pressure of the tongs except where they are pinned to each other. Thus, since the internal jaws are located at the end of the device most remote from the pinned portions, it is obvious that pressure applied to the device by a set of tongs on the outside diameter of the device will reduce the diameter of the device at said remote end and force the jaws to dig into the surface of the blank pipe portion underlying them. Such engagement by a set of tongs will permit the length of well screen to be threadedly joined to an adjacent length of well screen.

BRIEF DESCRIPTION OF THE DRAWINGS

FIG. 1 is a perspective view of two lengths of pipe base well screen which are being coupled together, with the assembly device of the present invention attached to the pin end of the upper length;

FIG. 2 is a top view of the well screen and assembly device of FIG. 1;

FIG. 3 is an enlarged, fragmentary perspective view of the upper edges of the assembly device prior to their being moved together and joned by a tapered locking pin;

FIG. 4 is a view similar to FIG. 3 but showing the edges after they are joined together; and FIG. 5 is a view similar to FIG. 3 but showing the pivoted edges of the device.

DETAILED DESCRIPTION OF THE INVENTION

Referring to FIG. 1, the assembly device of the invention is indicated generally at 10 in operative relationship to an upper length of pipe base well screen 12 which is to be threadedly attached or coupled to a lower identical length 14, by means of a coupling 16. Typically, the lengths of screen 12, 14 are supplied with one coupling 16 attached to what will be used as the upper end of the screen. Although not shown, the lower screen would typically be mounted on a rotary table with some type of slip or other device to guide and protect the screen jacket as it passes through the hole in the table and positively prevent the screen string from falling through the table. For example, the upper end of the screen 14 could be provided with a welded boss ring 20 which could engage the movable plates of a slip such as the one disclosed in copending application U.S. Ser. No. 401,500 filed July 26, 1982. In appropriate cooperating anti-rotation means are provided, such as vertically descending lugs on the bottom of ring 20, to engage complementary recesses in the slip plates (not shown), there would be no need to use wrenches or tongs to back up the lower screen 14 when screwing the upper screen 12 into the coupling 16. Alternatively, where coupling 16 can be assumed to be completely tightly engaged with screen 14, the boss ring 20 could be dispensed with since the bottom end of the coupling would rest on the slip and a backup wrench or tongs could be applied to the coupling. However, in such a situation, the screen string, including screen 14, would have to be lowered into contact with the slip by a means such as a lifting sub threaded to the top of the coupling rather than by an elevator attached under the coupling. Where boss rings are used, the string can be supported by either a lifting sub or an elevator. Where greater torques must be applied to the lower screen 14 than those achievable with the last named techniques, the lower screen could be engaged under a boss ring or under the coupling by an inverted variation of device 10 which would rest on a movable plate slip such as one of the type disclosed in the aforementioned copending application or in the conventional tapered bowl in the rotary table (not shown). In the latter situation, the handles 24 would preferably be removed and threaded into the opposite end of the device, which opposite end would of course be on top when attached near to the upper end of screen 14. Also, the outer profile of the device 10 could be tapered for a short distance on what would be the lower end during use so that a portion of it would seat in the aforementioned tapered bowl and prevent damage to the screen jacket 26.

The pipe base screen member indicated generally at 12 comprises a pipe base central support 30 which has a blank section 32 at its lower or pin end, terminating in a threaded end 34. Adjoining the blank section 32 and covering a perforated region (not shown) of the pipe 30 is the screen jacket 26 which is quite fragile relative to the base pipe 30 since it comprises helically wrapped and welded wire. The principle purpose of the device 10 is to provide an extended length vertical contact surface, such as 12 inches, which may be engaged on its exterior surface by a tong having a height of about 6–10 inches in order to transfer turning torque to the much shorter section of blank pipe 32. The device 10 comprises a pair of semicylindrical metal body members 38, 40 which are preferably hinged on one edge 38′, 40′ along their entire vertical length by hinge pin 44 (FIGS. 2 and 5). Their other edges 38″ and 40″ are spaced from each other for the major portion of their length except for short portions 38‴ and 40‴ at their end which is adapted to overlie the screen jacket 26. The internal diameters of the device 10 in the regions of the elastomeric liner 46 and the pipe engaging dies or jaws 48 are selected in accordance with the outer diameters of the blank pipe 32 and screen jacket 26. For example, the I.D. of the liner 46 should be such that when the halves 38, 40 are brought together by hand without compressing the liner, as shown in FIG. 3, the aperture 50 in member 38 should be at least partially aligned with aperture 52 in member 40. Thus, the tapered pin member 56 will be able to be driven into aperture 50 to cam edge surface 38‴ closer to edge surface 40‴. The camming action, which moves the members to their FIG. 4 position, will also compress the elastomeric liner 46 so as to retain the device 10 in a predetermined vertical position relative to the screen jacket 26. Thus, the device 10 will not drop onto the top of coupling 16 when, during use, it is intermittently disengaged by the tongs, as it would be when manual tongs are used. When power tongs are used, the device 10 would be compressed to cause the dies 48 to bite into the blank pipe 32 which would be rotated in one continuous operation to its final degree of tightness. However, where manual tongs are used, the operation is more like a pipe wrench with the jaws or dies of the tongs being in engagement with the device for only a portion of a revolution and then being released and rotated back to take another bite. In a manual tong the power is usually applied with a winch cable.

Although the dies 48 appear in FIG. 1 as a cross-section which gives the impression that they might slip around the work, they are actually grooved at several diagonals to enhance their bite. Their shape would be the conventional shape used for tong dies. In order not to damage the screen jacket 26 during installation, and to facilitate assembly to the screen member 12, the dies 48 preferably are made of hardened steel and have about a 3 inch maximum height so as to give about 0.5 inch clearance from the screen jacket and the last thread on pipe 32. The elastomeric liner 46 has about an 8 inch minimum height and is preferably about 0.187–0.250 inch thick while it is preferably compressed about 0.030 during use.

We claim as our invention:

1. Apparatus for assemblying pipe base well screens having blank end sections which are too short to be engaged by power tongs, said apparatus comprising a pair of semicylindrical body members which are hinged to each other at one pair of adjacent edges so that said body members may be assembled around a section of pipe base well screen in overlying relation to both a blank end section and an axially adjacent screen jacket section, said body members having cooperating fastening means on their other pair of adjacent edges and an elastomeric liner portion attached to their inner surfaces at one end portion thereof, the other end of said body members having serrated jaw portions attached to their inner surfaces, said cooperating fastening means being adapted to draw said other pair of adjacent edges towards each other to reduce the internal diameter of said body members and compress and force said elastomeric liner portions into friction engagement with a section of screen jacket which they overlie, said other pair of adjacent edges being spaced from each other at least in the region overlying said other end of said body members and a portion of said screen jacket so that an external wrench or tong force applied to the outer surface of said body members in said region will cause a decrease in the internal diameter of said body members and engagement of said serrated jaw portions with said blank end section but will not deform said screen jacket portion.

2. Apparatus in accordance with claim 1 wherein said body members have an axial length at least about twice the axial length of the blank end section to be engaged.

3. Apparatus in accordance with claim 1 wherein said cooperating fastening means comprises offset apertures on said other pair of adjacent edges which are normally biased out of alignment by said elastomeric liner portion, and a tapered pin which is adapted to be driven into said offset aperture to align them and compress said elastomeric liner portion.

4. Apparatus in accordance with claim 1 wherein said liner portion has an axial length at least about twice the axial length of said serrated jaw portions.

5. Apparatus in accordance with claim 1 wherein said body members have handle means at one end thereof for permitting said body members to be axially positioned relative to a pipe base well screen until said cooperating fastening means are activated.

* * * * *